US005912580A

United States Patent [19]

Kimura

[11] Patent Number: 5,912,580

[45] Date of Patent: Jun. 15, 1999

[54] VOLTAGE REFERENCE CIRCUIT

[75] Inventor: Katsuji Kimura, Tokyo, Japan

[73] Assignee: NEC Corporation, Tokyo, Japan

[21] Appl. No.: 08/808,906

[22] Filed: Mar. 3, 1997

[30] Foreign Application Priority Data

Mar. 1, 1996 [JP] Japan ..... 8-071455

[51] Int. Cl.[6] ..... G05F 1/10

[52] U.S. Cl. ..... 327/530; 323/313; 327/540; 327/541

[58] Field of Search ..... 323/312, 313, 323/315; 327/530, 534, 535, 537, 538, 539, 540, 541, 543, 545, 546

[56] References Cited

U.S. PATENT DOCUMENTS

| | | | |
|---|---|---|---|
| 3,930,172 | 12/1975 | Dobkin | 307/297 |
| 4,491,780 | 1/1985 | Neidorff | 323/313 |
| 5,399,914 | 3/1995 | Brewster | 327/530 |
| 5,432,432 | 7/1995 | Kimura | 323/313 |

*Primary Examiner*—Timothy P. Callahan

*Assistant Examiner*—Jeffrey Zweizig

*Attorney, Agent, or Firm*—Sughrue, Mion, Zinn, Macpeak & Seas, PLLC

[57] ABSTRACT

A voltage reference circuit capable of realization of two reference voltages having different temperature coefficients is provided. This circuit includes a first bipolar transistor, a second bipolar transistor, and first, second, and third resistors. An emitter of the first transistor is directly connected to a fixed voltage level. An emitter of the second transistor is connected to the fixed voltage level through the first resistor. A collector of the first transistor is connected to a base of the second transistor. A collector of the second transistor is connected to a base of the first transistor. A first end of the second resistor is connected to the connection point of the collector of the first transistor and the base of the second transistor. A first end of the third resistor is connected to the connection point of the collector of the second transistor and the base of the first transistor. The first transistor is driven by a first driving current through the second resistor. The second transistor is driven by a second driving current through the third resistor. A first reference voltage is derived from a second end of the second resistor. A second reference voltage is derived from a second end of the third resistor.

12 Claims, 5 Drawing Sheets

VOLTAGE REFERENCE CIRCUIT

BACKGROUND OF THE INVENTION

1. Field of the Invention

The present invention relates to a voltage reference circuit and more particularly, to a voltage reference circuit that is able to generate two reference voltages each having a temperature dependence, which is operable at a low supply voltage, and has a simple circuit configuration.

2. Description of the Prior Art

To generate two reference voltages each having a fixed temperature coefficient, conventionally, two independent voltage reference circuits have been used in combination.

At present, there have been known a practical voltage reference circuit that can generate simultaneously two reference voltages each having a specific temperature characteristic.

A voltage reference circuit has been used for various electronic circuits to provide a specific biasing voltage therein. Especially, the "bandgap reference" circuit has been well known and popularly and widely used for the electronic circuits requiring high stability and high accuracy.

The "bandgap reference" circuit is realized by combining a first voltage dependent upon the base-to-emitter voltage $V_{BE}$ of a bipolar transistor having a negative temperature coefficient with a second voltage dependent upon the thermal voltage $V_T$ having a positive temperature coefficient, resulting in a wanted temperature dependence. A positive, negative or zero temperature coefficient can be generated by proper weighting the first and second voltages.

The base-to-emitter voltage of a bipolar transistor is approximately 600 mV, which has a negative temperature coefficient of approximately −2 mV/deg. Therefore, the output reference voltage of the "bandgap reference" circuit will have a zero temperature coefficient at approximately 1.205 V, which is equal to the bandgap voltage of silicon (Si). The reference voltage will be negative at a voltage lower than approximately 1.205 V, and positive at a voltage higher than approximately 1.205 V, which has been well known.

Recently, the integration scale of the Large-Scale Integrated circuits (LSIs) has been progressing more and more, and as a result, there has been an increasing possibility that a plurality of circuit blocks are integrated on the same semiconductor chip. In this case, the plurality of circuit blocks do not always require their bias voltages to have the same temperature dependence or characteristic. It has been often needed that the bias voltages of the plurality of circuit blocks are different in temperature dependence or characteristic.

To cope with the need of two reference voltages having different temperature coefficients, two separate voltage reference circuits may be simply used in combination. However, the combination of the two separate voltage reference circuits will cause some problems relating to circuit scale and current consumption.

SUMMARY OF THE INVENTION

Accordingly, an object of the present invention is to provide a voltage reference circuit capable of realization of two reference voltages having different temperature coefficients.

Another object of the present invention is to provide a voltage reference circuit capable of reduction in circuit scale and current consumption.

A voltage reference circuit according to a first aspect of the present invention includes a first bipolar transistor, a second bipolar transistor, and first, second, and third resistors.

An emitter of the first transistor is directly connected to a fixed voltage level. An emitter of the second transistor is connected to the fixed voltage level through the first resistor.

A collector of the first transistor is connected to a base of the second transistor. A collector of the second transistor is connected to a base of the first transistor.

A first end of the second resistor is connected to the connection point of the collector of the first transistor and the base of the second transistor. A first end of the third resistor is connected to the connection point of the collector of the second transistor and the base of the first transistor.

The first transistor is driven by a first driving current through the second resistor. The second transistor is driven by a second driving current through the third resistor.

A first reference voltage is derived from a second end of the second resistor. A second reference voltage is derived from a second end of the third resistor.

With the voltage reference circuit according to the first aspect of the present invention, the collector of the first transistor is connected to the base of the second transistor, and the collector of the second transistor is connected to the base of the first transistor. Also, the first transistor is directly connected to the fixed voltage level, and the second transistor is connected to the fixed voltage level through the first transistor. Further, the first and second transistors are driven by the first and second driving currents through the second and third resistors, respectively.

Therefore, the difference between the base-to-emitter voltages of the first and second transistors is proportional to the second driving current.

On the other hand, since the first and second reference voltages are derived from the second ends of the second and third resistors, respectively, each of the first and second reference voltages is dependent upon the base-to-emitter voltage difference of the first and second transistors.

Accordingly, two reference voltages having different temperature coefficients can be realized as the first and second reference voltages by changing the resistance of the first, second, and third resistors.

Also, since the voltage reference circuit according to the first aspect is basically formed by first and second bipolar transistors and the first resistor, the circuit scale and current consumption can be reduced.

A voltage reference circuit according to a second aspect of the present invention includes a first Metal-Oxide-Semiconductor Field-Effect Transistor (MOSFET), a second MOSFET, and first, second, and third resistors.

A source of the first MOSFET is directly connected to a fixed voltage level. A source of the second MOSFET is directly connected to the fixed voltage level.

A drain of the first MOSFET is connected to a gate of the second MOSFET. A drain of the second MOSFET is connected to a gate of the first MOSFET.

A first end of the first resistor is connected to the drain of the first MOSFET, and a second end thereof is connected to a first end of the second resistor. A first end of the third resistor is connected to the drain of the second MOSFET.

The first MOSFET is driven by a first driving current through the first and second resistors. The second MOSFET is driven by a second driving current through the third resistor.

A first reference voltage is derived from a second end of the second resistor. A second reference voltage is derived from a second end of the third resistor.

With the voltage reference circuit according to the second aspect of the present invention, the drain of the first MOSFET is connected to the gate of the second MOSFET, and the drain of the second MOSFET is connected to the gate of the first MOSFET. Also, the first and second MOSFETs are directly connected to the fixed voltage level, respectively. Further, the first MOSFET is driven by the first driving current through the second and third resistors, and the second MOSFET is driven by the second driving current through the third resistor.

Therefore, the difference between the gate-to-source voltages of the first and second MOSFETs is proportional to the first driving current.

On the other hand, since the first and second reference voltages are derived from the second ends of the second and third resistors, respectively, each of the first and second reference voltages is dependent upon the gate-to-source voltage difference of the first and second MOSFETs.

Accordingly, two reference voltages having different temperature coefficients can be realized as the first and second reference voltages by changing the resistance of the first, second, and third resistors.

Also, since the voltage reference circuit according to the second aspect is basically formed by first and second MOSFETs and the first, second, and third resistors, the circuit scale and current consumption can be reduced.

A voltage reference circuit according to a third aspect of the present invention corresponds to one obtained by replacing the first and second MOSFETs with first and second bipolar transistors in the voltage reference circuit according to the second aspect.

A voltage reference circuit according to a fourth aspect of the present invention corresponds to one obtained by replacing the first and second bipolar transistors with first and second MOSFETs in the voltage reference circuit according to the first aspect.

With the voltage reference circuits according to the third and fourth aspects, the same advantages as those in the circuit according to the first aspect can be obtained.

In the voltage reference circuits according to the first and third aspects, the first and second bipolar transistors may have the same emitter area or different emitter areas.

In the voltage reference circuits according to the second and fourth aspects, the first and second MOSFETs may have the same ratio or different ratios of the gate-width to gate-length ratio.

BRIEF DESCRIPTION OF THE DRAWINGS

In order that the present invention maybe readily carried into effect, it will now be described with reference to the accompanying drawings.

DETAILED DESCRIPTION OF THE PREFERRED EMBODIMENTS

Figure 1:
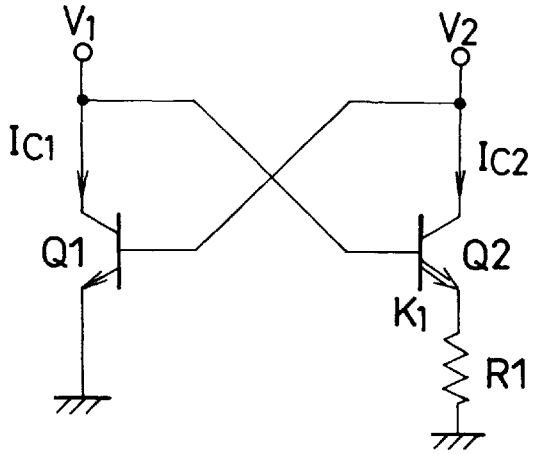
FIG. 1 is a circuit diagram of a subcircuit of a bipolar voltage reference circuit according to a first embodiment of the present invention.

Preferred embodiments of the present invention will be described below referring to the drawings attached.

First Embodiment

Figure 2:
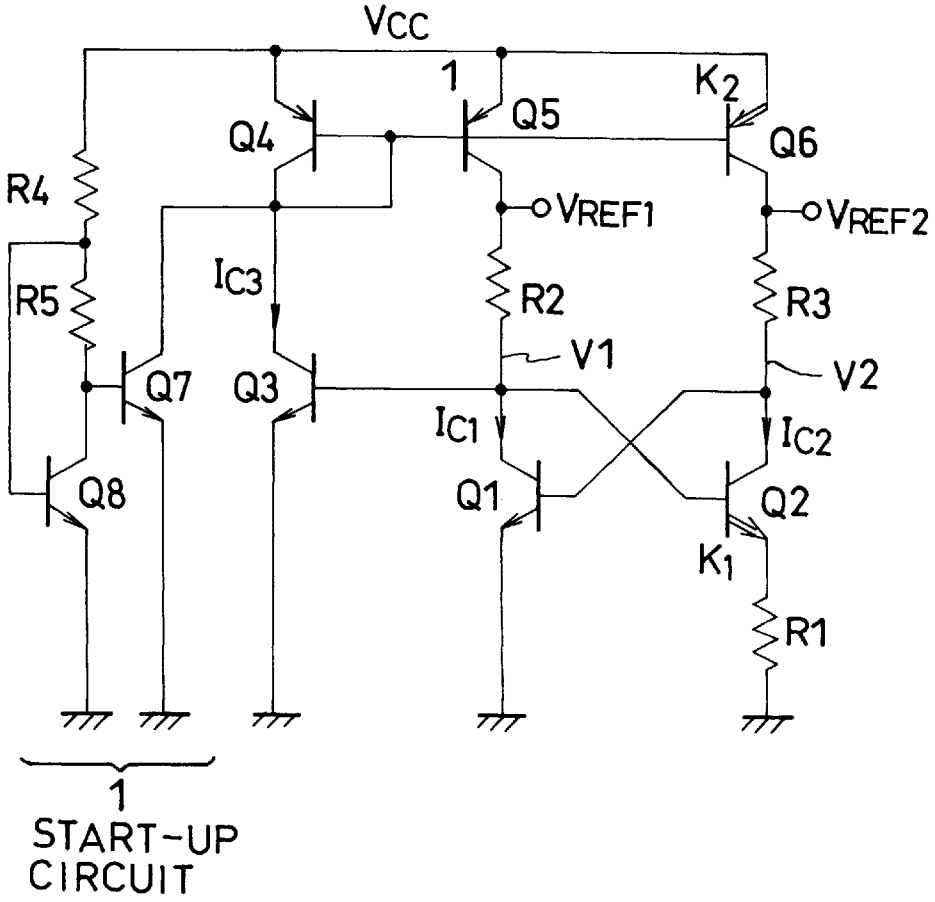
FIG. 2 is a circuit diagram of the bipolar voltage reference circuit according to the first embodiment, which includes the subcircuit of FIG. 1.

A bipolar voltage reference circuit according to a first embodiment is shown in FIGS. 1 and 2.

As shown in FIGS. 1 and 2, the voltage reference circuit according to the first embodiment includes two npn bipolar transistors Q1 and Q2, and three resistors R1, R2, and R3. The emitter area of the transistor Q2 is $K_1$ times as large as that of the transistor Q1, where $K_1$ is a positive constant greater than unity (i.e., $K_1>1$). Here, the transistor Q1 is a unit transistor.

An emitter of the transistor Q1 is directly connected to the ground. An emitter of the transistor Q2 is connected to the ground through the resistor R1 with a resistance R1. In other words, a first end of the resistor R1 is connected to the ground and a second end thereof is connected to the emitter of the transistor Q2.

A collector of the transistor Q1 is connected to a base of the transistor Q2. A collector of the transistor Q2 is connected to a base of the transistor Q1.

A first end of the resistor R2 is connected to the connection point of the collector of the transistor Q1 and the base of the transistor Q2. A first end of the resistor R3 with a resistance R3 is connected to the connection point of the collector of the transistor Q2 and the base of the transistor Q1.

The transistor Q1 is driven by a first driving current through the resistor R2. The transistor Q2 is driven by a second driving current through the resistor R3.

A first reference voltage $V_{REF1}$ is derived from a second end of the resistor R2. A second reference voltage $V_{REF2}$ is derived from a second end of the resistor R3.

The two transistors Q1 and Q2 are driven by a current mirror circuit formed by pnp bipolar transistors Q4, Q5, and Q6. An npn bipolar transistor Q3 serves to supply a reference current to the current mirror circuit. Thus, the reference current of the current mirror circuit is determined by the transistor Q3.

An emitter of the transistor Q3 is directly connected to the ground. A base of the transistor Q3 is connected to the connection point of the collector of the transistor Q1 and the base of the transistor Q2. A collector of the transistor Q3 is connected to a collector of the transistor Q4.

The transistor Q3 is biased by the base voltage of the transistor Q2 and therefore, the reference current of the current mirror circuit is determined by the base voltage of the transistor Q2.

The collector and a base of the transistor Q4 are coupled together to be connected to bases of the transistors Q5 and Q6. An emitter of the transistor Q4 is applied to the power supply voltage $V_{cc}$.

A collector of the transistor Q5 is connected to the second end of the resistor R2. An emitter of the transistor Q5 is applied to the power supply voltage $V_{cc}$.

A collector of the transistor Q6 is connected to the second end of the resistor R3. An emitter of the transistor Q6 is applied to the power supply voltage $V_{cc}$.

The emitter area of the transistor Q5 is the same as that of the transistor Q4. The emitter area of the transistor Q6 is $K_2$ times as large as that of the transistor Q4, where $K_2$ is a positive constant greater than unity (i.e, $K_2>1$). In other words, the transistor Q5 has a mirror ratio of 1 with respect to the transistor Q4, and the transistor Q6 has a mirror ratio of $K_2$ with respect to the transistor Q4.

Since the voltage reference circuit of the first embodiment is of a self-biasing type, a start-up circuit 1 is additionally provided to avoid the zero-current state. Here, the start-up circuit 1 is realized by the well-known "Nagata current mirror" circuit.

The start-up circuit 1 includes two npn bipolar transistors Q7 and Q8 and two resistors R4 and R5. Specifically, an emitter of the transistor Q8 is directly connected to the ground. A collector of the transistor Q8 is connected to one end of the resistor R5. The other end of the resistor R5 is connected to one end of the resistor R4. The other end of the resistor R4 is applied with the supply voltage $V_{cc}$. A base of the transistor Q8 is connected to the connection point of the resistors R4 and R5.

An emitter of the transistor Q7 is directly connected to the ground. A base of the transistor Q7 is connected to the collector of the transistor Q8. A collector of the transistor Q7 is connected to the coupled base and collector of the transistor Q4.

Next, the operation of the voltage reference circuit according to the first embodiment is explained below.

Here, supposing that the base-width modulation (i.e., the Early voltage) is ignored, a collector current $I_c$ of a bipolar transistor is typically expressed as the following equation (1).

$$I_C = KI_S\exp\left(\frac{V_{BE}}{V_T}\right) \tag{1}$$

In the equation (1), $V_{BE}$ is the base-to-emitter voltage of the unit bipolar transistor, $I_5$ is the saturation current thereof, and K is the emitter area ratio with respect to the unit transistor. $V_T$ is the thermal voltage defined as $V_T=kT/q$, where k is the Boltzmann's constant, T is absolute temperature in degrees Kelvin, and q is the charge of an electron.

In the following analysis, for the sake of simplification, it is supposed that the common-base current gain factor of the transistor is approximately equal to unity and therefore, the base current can be ignored.

Here, the collector current of the transistors Q1, Q2, and Q3 are defined as $I_{C1}$, $I_{C2}$, and $I_{C3}$, and the base-to-emitter voltage thereof are defined as $V_{BE1}$, $V_{BE2}$, and $V_{BE3}$, respectively. Then, the following equations (2) and (3) are established.

$$V_{BE1} = V_T\ln\left(\frac{I_{C1}}{I_S}\right) \tag{2}$$

$$V_{BE2} = V_T\ln\left(\frac{I_{C2}}{K_1 I_S}\right) \tag{3}$$

If the voltages at the collectors of the transistor Q1 and Q2 are defined as $V_1$ and $V_2$, respectively, the following equations (4), and (5) are established.

$$V_1=V_{BE2}+R_1I_{C2} \tag{4}$$

$$V_2=V_{BE1} \tag{5}$$

The transistor Q5 has a mirror ratio of 1 with respect to the transistor Q4, and the transistor Q6 has a mirror ratio of $K_2$ with respect to the transistor Q4 in the current mirror circuit. Therefore, the collector current (i.e., mirror current) $I_{C2}$ of the transistor Q2 is $K_2$ times as much as the collector current (i.e., reference current) $I_{C3}$ of the transistor Q3. The collector current (i.e., mirror current) $I_{C1}$ of the transistor Q1 is equal to the collector current $I_{C3}$. Accordingly, the following equations (6) and (7) are obtained.

$$I_{C2}=K_2I_{C1} \tag{6}$$

$$O_{C3}=I_{C1} \tag{7}$$

It is seen from the equation (7) that the base-to-emitter voltage $V_{BE1}$ of the transistor Q1 is equal to the base-to-emitter voltage $V_{BE3}$ of the transistor Q3, i.e., $V_{BE1}=V_{BE3}$.

Also, the voltages $V_1$ and $V_2$ at the collectors of the transistors Q1 and Q2 are equal, i.e., $V_1=V_2$.

Therefore, the difference between the base-to-emitter voltages $V_{BE1}$ and $V_{BE2}$, i.e., $\Delta V_{BE}$, is expressed as $$\Delta V_{BE} = V_{BE1} - V_{BE2} = V_T\ln\left(\frac{K_1}{K_2}\right) = R_1I_{C2} \tag{8}$$

In the expression (8), $K_1$ and $K_2$ are the temperature-independent constants. The thermal voltage $V_T$ is proportional to the absolute temperature T and has a positive temperature coefficient of 3333 ppm/deg, because $V_2=kT/q$. Therefore, it is seen from the expression (8) that the base-to-emitter voltage difference $\Delta V_{BE}$ is proportional to the absolute temperature T. The temperature coefficient of the difference $\Delta V_{BE}$ is positive.

The first reference voltage $V_{REF1}$ is a voltage at the connection point of the collector (the first output end of the current mirror circuit) of the transistor Q5 and the second end of the resistor R2. The second reference voltage $V_{REF2}$ is a voltage at the connection point of the collector (the second output end of the current mirror circuit) of the transistor Q6 and the second end of the resistor R3.

Accordingly, the first and second reference voltages $V_{REF1}$ and $V_{REF2}$ are expressed as $$V_{REF1} = V_1 + R_2I_{C1} = V_{BE1} + \frac{R_2}{R_1K_2}\Delta V_{BE} \tag{9}$$

-continued $$V_{REF2} = V_2 + R_3 I_{C2} = V_{BE1} + \frac{R_3}{R_1}\Delta V_{BE} \quad (10)$$

It is seen from the expressions (9) and (10) that each of the first and second reference voltages $V_{REF1}$ and $V_{REF2}$ is expressed by the weighting sum of the base-to-emitter voltage $V_{BE1}$ of the transistor Q1 and the base-to-emitter voltage difference $\Delta V_{BE}$, where the base-to-emitter voltage $V_{BE1}$ has a negative temperature coefficient, and the difference $\Delta V_{BE}$ has a positive temperature coefficient.

Therefore, in the same way as that of the "bandgap reference" circuit, a positive, negative, or zero temperature coefficient can be generated as necessary by proper weighting the two voltages of $V_{BE1}$ and $\Delta V_{BE}$, resulting in a wanted temperature dependence.

The weighting of $V_{BE1}$ and $\Delta V_{BE}$ is able to be performed by suitably determining at least one of the emitter area ratio $K_1$, the mirror ratio $K_2$, and the ratios (R2/R1) and (R3/R1) of the resistances R1, R2 and R3.

As described above, with the voltage reference circuit according to the first embodiment of FIGS. 1 and 2, the collector of the transistor Q1 is connected to the base of the transistor Q2, and the collector of the transistor Q2 is connected to the base of the transistor Q1. The emitter of the transistor Q1 is directly connected to the ground, and the emitter of the transistor Q2 is connected to the ground through the resistor R1. Further, the transistors Q1 and Q2 are driven by the first and second driving currents $I_{C1}$ and $I_{C2}$ through the resistors R2 and R3, respectively.

Therefore, the difference $\Delta V_{BE}$ between the base-to-emitter voltages $V_{BE1}$ and $V_{BE2}$ of the transistors Q1 and Q2 is proportional to the second driving current $I_{C2}$.

On the other hand, since the first and second reference voltages $V_{REF1}$ and $V_{REF2}$ are derived from the second ends of the resistors R2 and R3, respectively, each of the reference voltages $V_{REF1}$ and $V_{REF2}$ is dependent upon the base-to-emitter voltage difference $\Delta V_{BE}$ of the transistors Q1 and Q2.

Accordingly, the first and second reference voltages $V_{REF1}$ and $V_{REF2}$ having different the same or different temperature coefficients can be realized by changing the resistance of the resistors R1, R2, and R3.

Also, since the voltage reference circuit according to the first embodiment is basically formed by the transistors Q1 and Q2 and the resistors R1, R2, and R3, the circuit scale and current consumption can be reduced.

Second Embodiment

Figure 3:
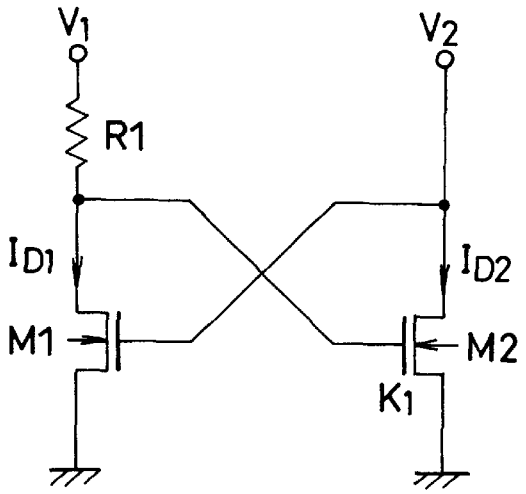
FIG. 3 is a circuit diagram of a subcircuit of a MOS voltage reference circuit according to a second embodiment of the present invention.
Figure 4:
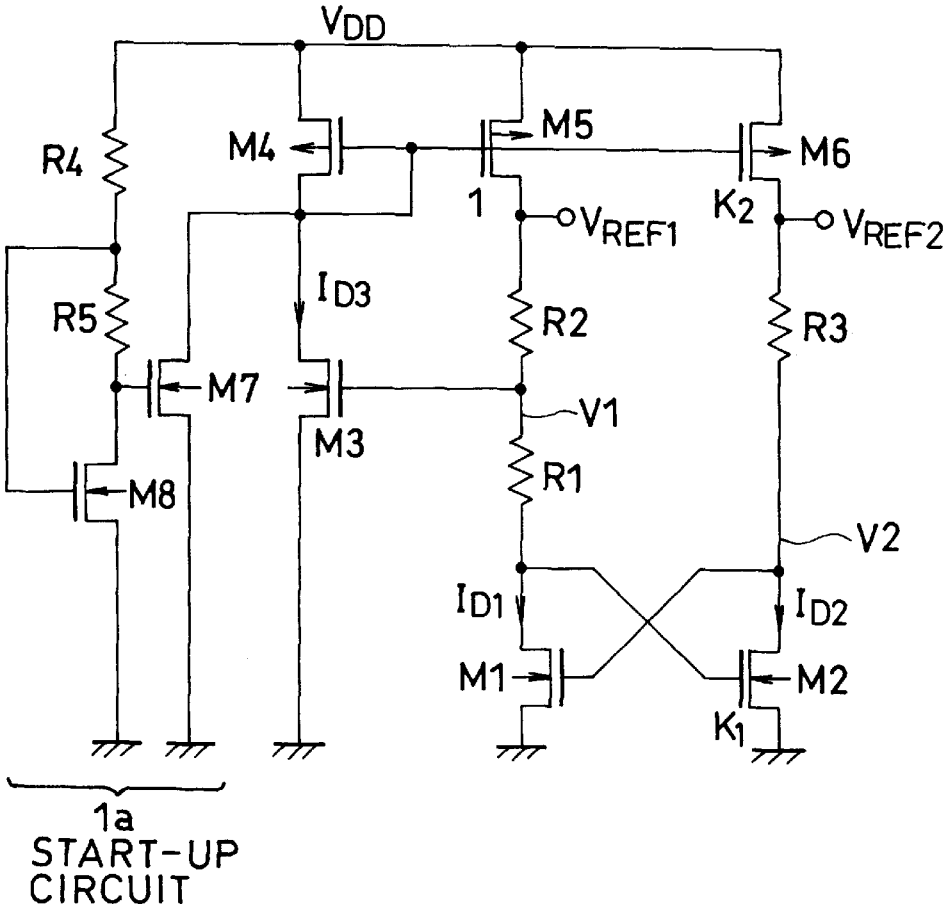
FIG. 4 is a circuit diagram of the MOS voltage reference circuit according to the second embodiment, which includes the subcircuit of FIG. 3.

A MOS voltage reference circuit according to a second embodiment is shown in FIGS. 3 and 4.

As shown in FIGS. 3 and 4, the voltage reference circuit according to the second embodiment includes two n-channel MOSFETs M1 and M2, and three resistors R1, R2, and R3. The ratio (W/L) of the gate-width (W) to the gate-length (L) of the MOSFET M2 is $K_1$ times as large as that of the MOSFET M1, where $K_1$ is a positive constant greater than unity (i.e., $K_1>1$). Here, the MOSFET M1 is a unit transistor.

A source of the MOSFET M1 is directly connected to the ground. A source of the MOSFET M2 is also directly connected to the ground. A drain of the MOSFET M1 is connected to a gate of the MOSFET M2. A drain of the MOSFET M2 is connected to a gate of the MOSFET M1.

The resistors R1 and R2 are connected in series and connected to the drain of the MOSFET M1. Specifically, a first end of the resistor R1 with a resistance R1 is connected to the drain of the MOSFET M1. A second end of the resistor R1 is connected to a first end of the resistor R2 with a resistance R2. A first end of the resistor R3 is connected to the drain of the MOSFET M2.

The MOSFET M1 is driven by a first driving current through the serially-connected resistors R1 and R2. The MOSFET M2 is driven by a second driving current through the resistor R3.

A first reference voltage $V_{REF1}$ is derived from a second end of the resistor R2. A second reference voltage $V_{REF2}$ is derived from a second end of the resistor R3.

The two MOSFET M1 and M2 are driven by a current mirror circuit formed by p-channel MOSFETs M4, M5, and M6. An n-channel MOSFET M3 serves to supply a reference current to the current mirror circuit. Thus, the reference current of the current mirror circuit is determined by the MOSFET M3.

A source of the MOSFET M3 is directly connected to the ground. A gate of the MOSFET M3 is connected to the connection point of the resistors R1 and R2. A drain of the MOSFET M3 is connected to a drain of the MOSFET M4.

The MOSFET M3 is biased by the voltage at the connection point of the resistors R1 and R2 and therefore, the reference current of the current mirror circuit is determined by the voltage at the connection point of the resistors R1 and R2.

The drain and a gate of the MOSFET M4 are coupled together to be connected to gates of the MOSFETs M5 and M6. A source of the MOSFET M4 is applied to the power supply voltage $V_{DD}$.

A drain of the MOSFET M5 is connected to the second end of the resistor R2. A source of the MOSFET M5 is applied to the power supply voltage $V_{DD}$.

A drain of the MOSFET M6 is connected to the second end of the resistor R3. A source of the MOSFET M6 is applied to the power supply voltage $V_{DD}$.

The gate-width to gate-length ratio (W/L) of the MOSFET M5 is the same as that of the MOSFET M4. The gate-width to gate-length ratio (W/L) of the MOSFET M6 is $K_2$ times as large as that of the MOSFET M4, where $K_2$ is a positive constant greater than unity (i.e., $K_2>1$). In other words, the MOSFET M5 has a mirror ratio of 1 with respect to the MOSFET M4, and the MOSFET M6 has a mirror ratio of $K_2$ with respect to the MOSFET M4.

Since the voltage reference circuit of the second embodiment is of a self-biasing type, a start-up circuit 1*a* is additionally provided to avoid the zero-current state. Here, the start-up circuit 1*a* is realized by the well-known "Nagata current mirror" circuit.

The start-up circuit 1*a* includes two n-channel MOSFETs M7 and M8 and two resistors R4 and R5. Specifically, a source of the MOSFET M8 is directly connected to the ground. A drain of the MOSFET M8 is connected to one end of the resistor R5. The other end of the resistor R5 is connected to one end of the resistor R4. The other end of the resistor R4 is applied with the supply voltage $V_{DD}$. A gate of the MOSFET M8 is connected to the connection point of the resistors R4 and R5.

A source of the MOSFET M7 is directly connected to the ground. A gate of the MOSFET M7 is connected to the drain of the MOSFET M8. A drain of the MOSFET M7 is connected to the coupled gate and drain of the MOSFET M4.

Next, the operation of the voltage reference circuit according to the second embodiment is explained below.

Supposing that each of the MOSFETs are matched in characteristic, and ignoring the channel-length modulation and the body effect, the drain current $I_{D1}$ of the MOSFET M1 is typically expressed as the following equation $$L_{D1}=\beta(V_{GS1}-V_{TH})^2 \tag{11}$$

where β is the transconductance parameter, $V_{GS1}$ is the gate-to-source voltage of the MOSFET M1, and $V_{TH}$ is the threshold voltage thereof.

It is seen from the equation (11) that the drain current $I_{D1}$ varies according to the square-law with respect to the gate-to-source voltage $V_{GS1}$.

Here, β is defined as $$\beta=\mu\left(\frac{Cox}{2}\right)\left(\frac{W}{L}\right)$$

where $\mu$ is the effective mobility of a carrier, $C_{OX}$ is the gate-oxide capacitance per unit area, and W and L are the gate width and the gate length of the MOSFET M1, respectively.

The drain current $I_{D2}$ of the MOSFET M2 is expressed by the following equation (12) as $$I_{D2}=K_1\beta(V_{GS2}-V_{TH})^2 \tag{12}$$

If the voltages at the drains of the MOSFETs M1 and M2 are defined as $V_1$ and $V_2$, respectively, the following equations (13), and (14) are established $$V_1=V_{GS2}+R_1I_{D1} \tag{13}$$

$$V_2=V_{GS1} \tag{14}$$

where $V_{GS2}$ is the gate-to-source voltage of the MOSFET M2.

The MOSFET M5 has a mirror ratio of 1 with respect to the MOSFET M4, and the MOSFET M6 has a mirror ratio of $K_2$ with respect to the MOSFET M4 in the current mirror circuit. Therefore, the drain current (i.e., mirror current) $I_{D2}$ of the MOSFET M2 is $K_2$ times as much as the drain current (i.e., reference current) $I_{D3}$ of the MOSFET M3. The drain current (i.e., mirror current) $I_{D1}$ of the MOSFET M1 is equal to the drain current $I_{D3}$. Accordingly, the following equations (15) and (16) are obtained.

$$I_{D2}=K_2I_{D1} \tag{15}$$

$$I_{D3}=I_{D1} \tag{16}$$

It is seen from the equation (16) that the gate-to-source voltage $V_{GS1}$ of the MOSFET M1 is equal to the gate-to-source voltage $V_{BE3}$ of the MOSFET M3, i.e., $V_{GS1}=V_{GS3}$.

Also, the voltages $V_1$ and $V_2$ at the drains of the MOSFETs M1 and M2 are equal, i.e., $V_1=V_{GS2}+R_1\cdot I_{D1}=V_2=V_{GS1}$.

Therefore, the difference between the gate-to-source voltages $VGS_1$ and $V_{GS2}$, i.e., $\Delta V_{GS}$, is expressed as $$\Delta V_{GS}=V_{GS1}-V_{GS2}=R_1I_{D1} \tag{17}$$

From the above equations (11) and (12), $$V_{GS1}=V_{TH}+(I_{D1}/\beta)^{1/2}, \text{ and } V_{GS2}=V_{TH}+[I_{D2}/(K_1\beta)]^{1/2}$$

are obtained. Then, these equations are substituted into the equation (17), and $I_{D2}$ is deleted using the above equation (15). Thus, the following equation (18) is obtained.

$$I_{D1}=\frac{1}{R_1{}^2\beta}\left(1-\sqrt{\frac{K_2}{K_1}}\right)^2 \tag{18}$$

In the expression (18), $K_1$ and $K_2$ are the temperature-independent constants.

The mobility $\mu$ has a temperature dependence. Therefore, as seen from the definition of β, the transconductance parameter β is temperature dependent. The temperature dependence of β is given by the following expression (19).

$$\beta=\beta_0\left(\frac{T}{T_0}\right)^{-\frac{3}{2}} \tag{19}$$

where $\beta_0$ is the value of β at room temperature ($T_0$=300 K).

From the expression (9), the following equation (20) is obtained as $$\frac{1}{\beta}=\frac{1}{\beta_0}\left(\frac{T}{T_0}\right)^{\frac{3}{2}} \tag{20}$$

Figure 5:
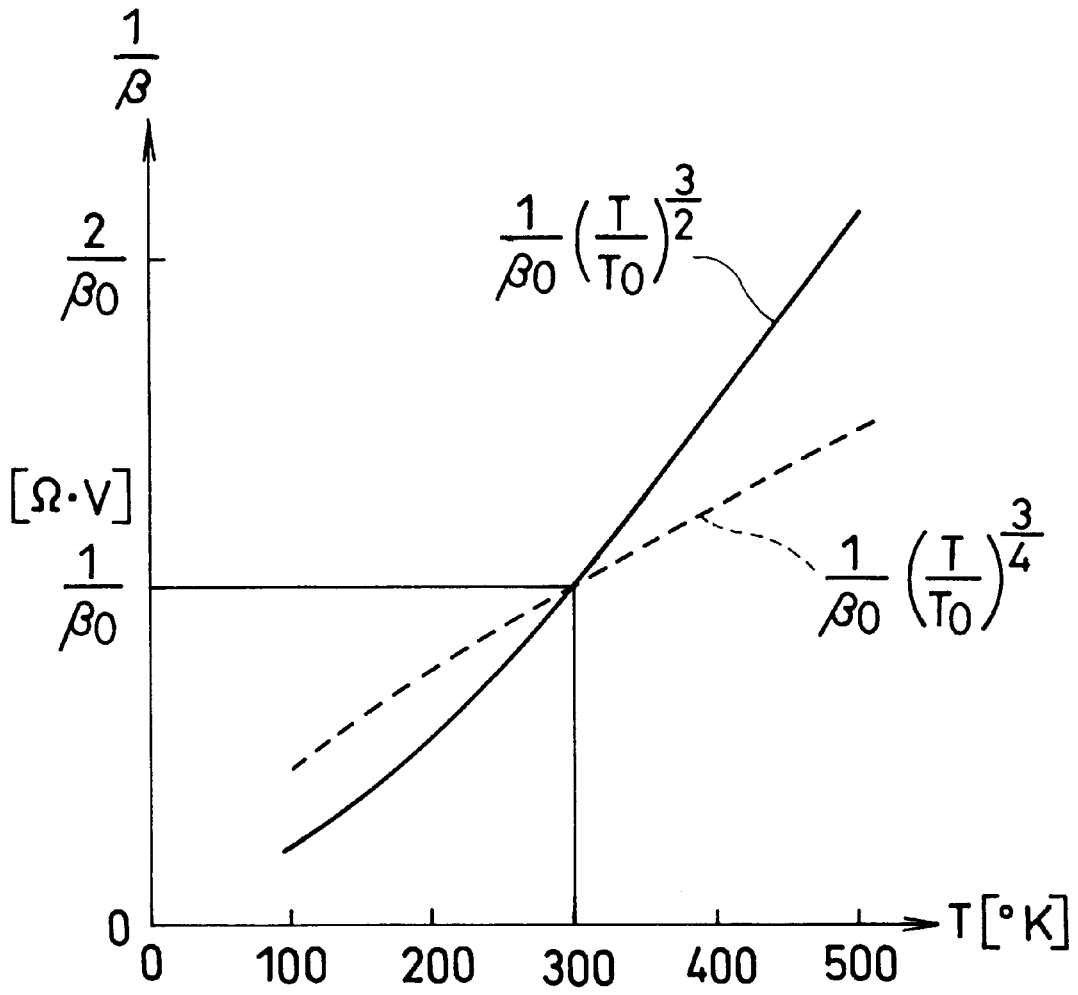
FIG. 5 is a graph showing the calculated temperature dependence of the transconductance parameter β of the MOSFET.

The calculated temperature dependence of the transconductance parameter β is shown in FIG. 5. It is seen from FIG. 5 that (1/β) has a positive temperature coefficient of 5000 ppm/deg, which is 1.5 times as large as the temperature coefficient (3333 ppm/deg) of the thermal voltage $V_T$ of the bipolar transistor.

Therefore, if the drain current $I_{D1}$ of the MOSFET M1 has a positive temperature coefficient and the temperature coefficient of the resistor R1 is equal to 5000 ppm/deg or less, the gate-to-source voltage difference $\Delta V_{GS}$ is proportional to the absolute temperature T. The temperature coefficient of the difference $\Delta V_{GS}$ is positive.

The first reference voltage $V_{REF1}$ is a voltage at the connection point of the drain (the first output end of the current mirror circuit) of the MOSFET M5 and the second end of the resistor R2. The second reference voltage $V_{REF2}$ is a voltage at the connection point of the drain (the second output end of the current mirror circuit) of the MOSFET M6 and the second end of the resistor R3.

Accordingly, the first and second reference voltages $V_{REF1}$ and $V_{REF2}$ are given by the following expressions (21) and (22), respectively.

$$V_{REF1}=V_1+R_2I_{D1}=V_{GS1}+\frac{R_3}{R_1}\Delta V_{GS} \tag{21}$$

$$V_{REF2}=V_2+R_3I_{D2}=V_{GS1}+K_2\frac{R_3}{R_1}\Delta V_{GS} \tag{22}$$

On the other hand, the gate-to-source voltage $V_{GS1}$ of the MOSFET M1 is given by the following expression (23).

$$V_{GS1}=\sqrt{\frac{I_{D1}}{\beta}}+V_{TH} \tag{23}$$

The equations (21) and (22) can be rewritten to the following expressions (24) and (25), respectively.

$$V_{REF1} = \frac{1}{R_1\beta}\left(1 - \sqrt{\frac{K_2}{K_1}}\right)\left(1 + \frac{R_2}{R_1}\right) + V_{TH} \quad (24)$$

$$V_{REF2} = \frac{1}{R_1\beta}\left(1 - \sqrt{\frac{K_2}{K_1}}\right)\left(1 + \frac{K_2R_3}{R_1}\right) + V_{TH} \quad (25)$$

The temperature dependence of the threshold voltage $V_T$ is expressed as $$\Delta V_{TH} = V_{TH} - \alpha(T - T_0) \quad (26)$$

where $V_{TH0}$ is the value of $V_T$ at room temperature (300 K) and $\alpha$ is a constant.

The constant $\alpha$ is equal to approximately 2.3 mV/deg for the Complementary MOS (CMOS) process with the low threshold voltage.

It is seen from the expressions (24) and (25) that each of the first and second reference voltages $V_{REF1}$ and $V_{REF2}$ is expressed by the weighting sum of the threshold voltage $V_T$ and the mobility $\mu$, where the threshold voltage $V_T$ has a negative temperature coefficient, and the mobility $\mu$ has a positive temperature coefficient.

Therefore, in the same way as that of the "bandgap reference" circuit, a positive, negative, or zero temperature coefficient can be generated as necessary by proper weighting the threshold voltage $V_T$ and the mobility $\mu$, resulting in a wanted temperature dependence.

The weighting of $V_T$ and $\mu$ is able to be performed by suitably determining at least one of the ratio $K_1$ of the gate-width to gate-length ratios (W/L), the mirror ratio $K_2$, and the ratios (R2/R1) and (R3/R1) of the resistances R1, R2 and R3.

As described above, with the voltage reference circuit according to the second embodiment of FIGS. 3 and 4, the drain of the MOSFET M1 is connected to the gate of the MOSFET M2, and the drain of the MOSFET M2 is connected to the gate of the MOSFET M1. The sources of the MOSFETs M1 and M2 are directly connected to the ground. Further, the MOSFETs M1 and M2 are driven by the first and second driving currents $I_{D1}$ and $I_{D2}$ through the resistors R1, R2 and R3, respectively.

Therefore, the difference $\Delta V_{GS}$ between the gate-to-source voltages $V_{GS1}$ and $V_{GS2}$ of the MOSFETs M1 and M2 is proportional to the second driving current $I_{D2}$.

On the other hand, since the first and second reference voltages $V_{REF1}$ and $V_{REF2}$ are derived from the second ends of the resistors R2 and R3, respectively, each of the reference voltages $V_{REF1}$ and $V_{REF2}$ is dependent upon the gate-to-source voltage difference $\Delta V_{GS}$ of the MOSFETs M1 and M2.

Accordingly, the first and second reference voltages $V_{REF1}$ and $V_{REF2}$ having different the same or different temperature coefficients can be realized by changing the resistance of the resistors R1, R2, and R3.

Also, since the voltage reference circuit according to the second embodiment is basically formed by the MOSFETs M1 and M2 and the resistors R1, R2, and R3, the circuit scale and current consumption can be reduced.

Third Embodiment

Figure 6:
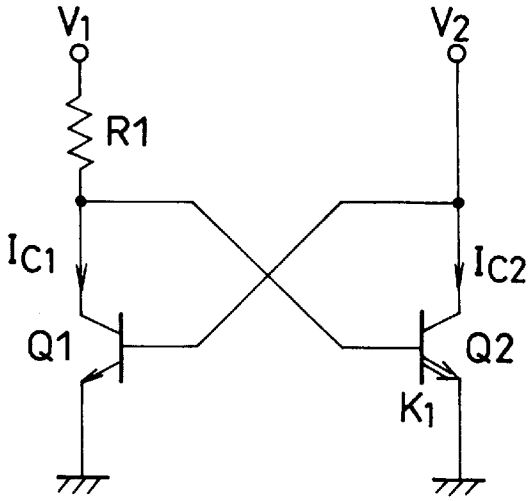
FIG. 6 is a circuit diagram of a subcircuit of a bipolar voltage reference circuit according to a third embodiment of the present invention.
Figure 7:
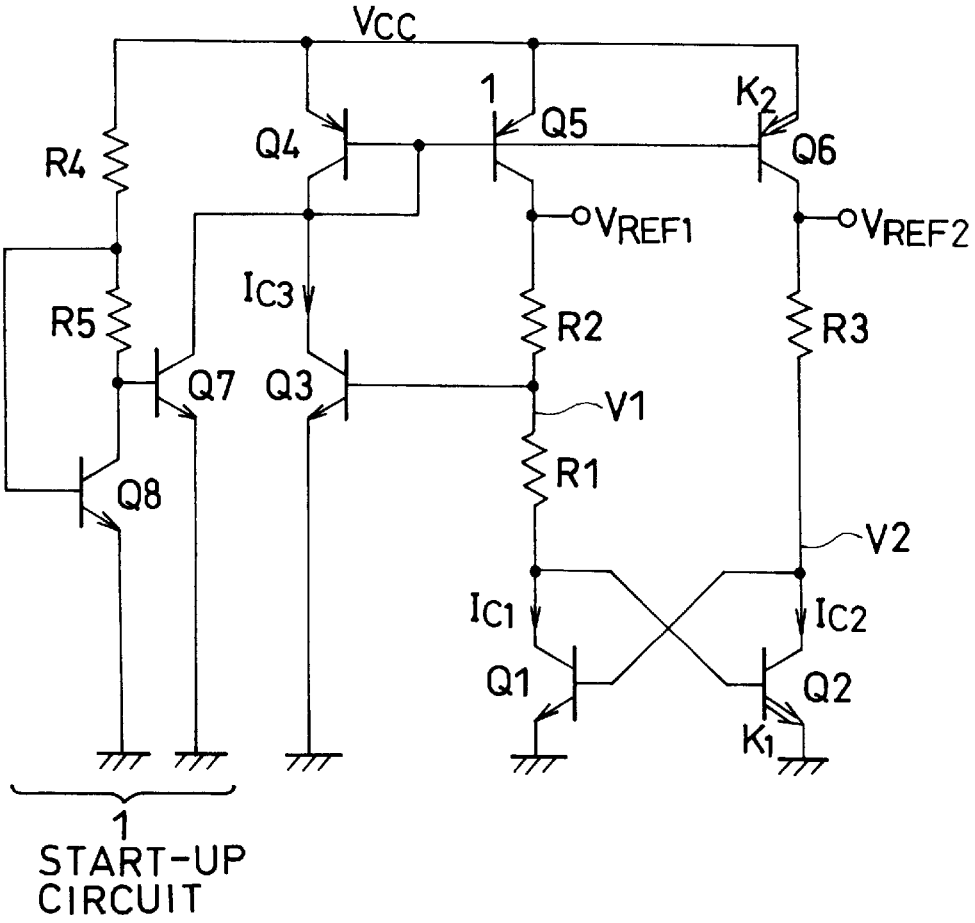
FIG. 7 is a circuit diagram of the bipolar voltage reference circuit according to the third embodiment, which includes the subcircuit of FIG. 6.

A bipolar voltage reference circuit according to a third embodiment is shown in FIGS. 6 and 7.

As shown in FIGS. 3, 4, 6, and 7, this voltage reference circuit corresponds to one obtained by replacing the MOSFETs M1 and M2 with bipolar transistors in the voltage reference circuit according to the second embodiment of FIGS. 3 and 4.

The configuration and operation of the circuit according to the third embodiment is the same as that of the first embodiment of FIGS. 1 and 2. Therefore, the explanation relating to the operation is omitted here by adding the same reference characters as those in the first embodiment of FIGS. 1 and 2 to the corresponding elements for the sake of simplification. It is clear that the same advantages as those in the first embodiment is obtained in the third embodiment.

Fourth Embodiment

Figure 8:
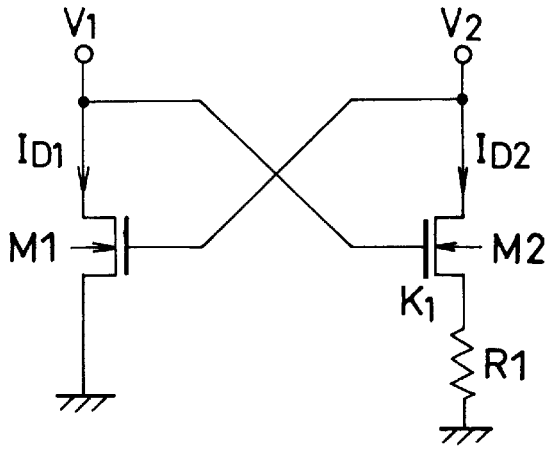
FIG. 8 is a circuit diagram of a subcircuit of a MOS voltage reference circuit according to a fourth embodiment of the present invention.
Figure 9:
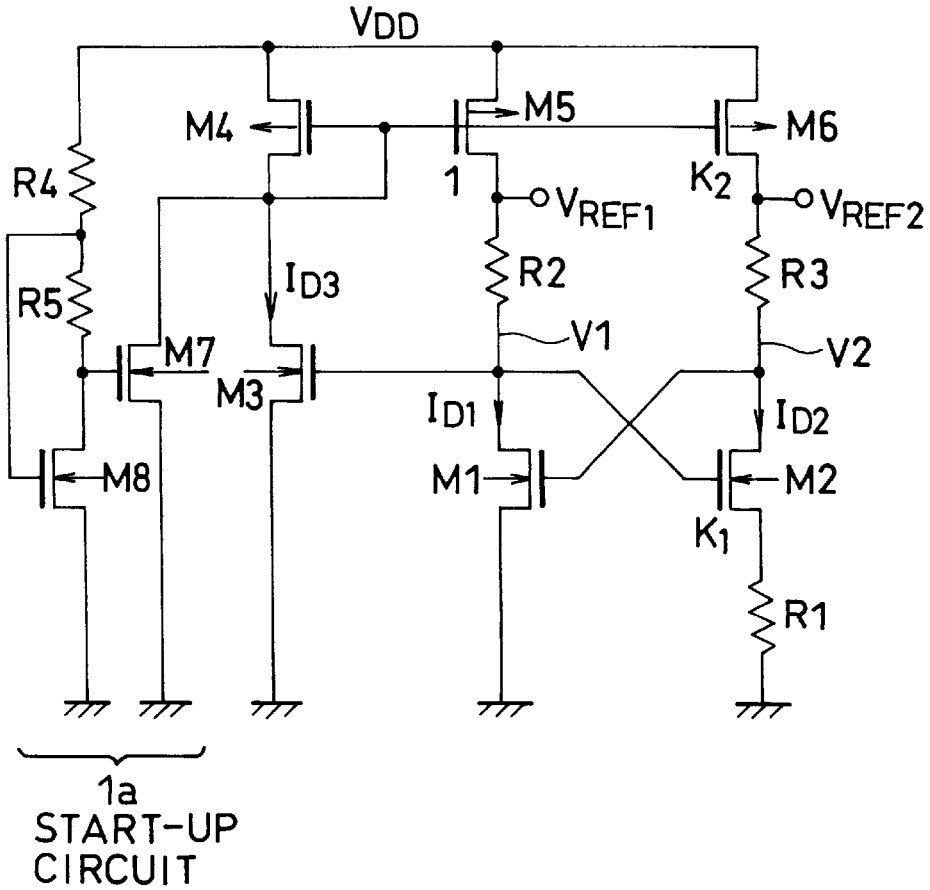
FIG. 9 is a circuit diagram of the MOS voltage reference circuit according to the fourth embodiment, which includes the subcircuit of FIG. 8.

A MOS voltage reference circuit according to a fourth embodiment is shown in FIGS. 8 and 9.

As shown in FIGS. 1, 2, 8, and 9, this voltage reference circuit corresponds to one obtained by replacing the bipolar transistors Q1 and Q2 with MOSFETs in the voltage reference circuit according to the first embodiment of FIGS. 1 and 2.

The configuration and operation of the circuit according to the fourth embodiment is the same as that of the second embodiment of FIGS. 3 and 4. Therefore, the explanation relating to the operation is omitted here by adding the same reference characters as those in the second embodiment of FIGS. 3 and 4 to the corresponding elements for the sake of simplification.

It is clear that the same advantages as those in the second embodiment is obtained in the fourth embodiment.

Additionally, since a MOSFET has a characteristic similar to the combination of a bipolar transistor and an emitter resistor, it is necessary that the transconductance parameter $\beta$ and/or the voltage drop due to the source resistor R1 is set as a sufficient large value.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A voltage reference circuit comprising:

a first bipolar transistor whose emitter is directly connected to a fixed voltage level;

a second bipolar transistor whose emitter is connected to said voltage level through a first resistor;

a collector of said first transistor being connected to a base of said second transistor;

a collector of said second transistor being connected to a base of said first transistor;

a second resistor having first and second ends;

the first end of said second resistor being connected to the connection point of the collector of said first transistor and the base of said second transistor;

a third resistor having first and second ends;

the first end of said third resistor being connected to the connection point of the collector of said second transistor and the base of said first transistor;

said first transistor being driven by a first driving current through said second resistor;

said second transistor being driven by a second driving current through said third resistor;

a first reference voltage being derived from a second end of said second resistor; and a second reference voltage being derived from a second end of said third resistor.

2. A circuit as claimed in claim 1, wherein said second bipolar transistor has an emitter area $K_1$ times as large as that of said first bipolar transistor, where $K_1$ is a constant greater than unity.

3. A circuit as claimed in claim 1, wherein said second driving current is $K_2$ times as large as that of the first driving current, where $K_2$ is a constant greater than unity.

4. A voltage reference circuit comprising:

a first MOSFET whose source is directly connected to a fixed voltage level;

a second MOSFET whose source is directly connected to said voltage level;

a drain of said first MOSFET being connected to a gate of said second MOSFET;

a drain of said second MOSFET being connected to a gate of said first MOSFET;

a first resistor having first and second ends;

a second resistor having first and second ends;

a third resistor having first and second ends;

the first end of said first resistor being connected to the drain of said first MOSFET;

the second end of said first resistor being connected to the first end of said second resistor;

the first end of said third resistor being connected to the drain of said second MOSFET;

said first MOSFET being driven by a first driving current through said first and second resistors;

said second MOSFET being driven by a second driving current through said third resistor;

a first reference voltage being derived from the second end of said second resistor; and a second reference voltage being derived from the second end of said third resistor.

5. A circuit as claimed in claim 4, wherein said second MOSFET has a gate-width to gate-length ratio $K_1$ times as large as that of said first MOSFET, where $K_1$ is a constant greater than unity.

6. A circuit as claimed in claim 4, wherein said second driving current is $K_2$ times as large as that of the first driving current, where $K_2$ is a constant greater than unity.

7. A voltage reference circuit comprising:

a first bipolar transistor whose emitter is directly connected to a fixed voltage level;

a second bipolar transistor whose emitter is directly connected to said voltage level;

a collector of said first bipolar transistor being connected to a base of said second bipolar transistor;

a collector of said second bipolar transistor being connected to a base of said first bipolar transistor;

a first resistor having first and second ends;

a second resistor having first and second ends;

a third resistor having first and second ends;

the first end of said first resistor being connected to the collector of said first bipolar transistor;

the second end of said first resistor being connected to the first end of said second resistor;

the first end of said third resistor being connected to the collector of said second bipolar transistor;

said first bipolar transistor being driven by a first driving current through said first and second resistors;

said second bipolar transistor being driven by a second driving current through said third resistor;

a first reference voltage being derived from the second end of said second resistor; and a second reference voltage being derived from the second end of said third resistor.

8. A circuit as claimed in claim 7, wherein said second bipolar transistor has an emitter area $K_1$ times as large as that of said first bipolar transistor, where $K_1$ is a constant greater than unity.

9. A circuit as claimed in claim 7, wherein said second driving current is $K_2$ times as large as that of the first driving current, where $K_2$ is a constant greater than unity.

10. A voltage reference circuit comprising:

a first MOSFET whose emitter is directly connected to a fixed voltage level;

a second MOSFET whose emitter is connected to said voltage level through a first resistor;

a collector of said first MOSFET being connected to a base of said second transistor;

a collector of said second MOSFET being connected to a base of said first transistor;

a second resistor having first and second ends;

the first end of said second resistor being connected to the connection point of the collector of said first MOSFET and the base of said second MOSFET;

a third resistor having first and second ends;

the first end of said third resistor being connected to the connection point of the drain of said second MOSFET and the gate of said first MOSFET;

said first MOSFET being driven by a first driving current through said second resistor;

said second MOSFET being driven by a second driving current through said third resistor;

a first reference voltage being derived from a second end of said second resistor; and a second reference voltage being derived from a second end of said third resistor.

11. A circuit as claimed in claim 10, wherein said second MOSFET has a gate-width to gate-length ratio $K_1$ times as large as that of said first MOSFET, where $K_1$ is a constant greater than unity.

12. A circuit as claimed in claim 10, wherein said second driving current is $K_2$ times as large as that of the first driving current, where K2 is a constant greater than unity.

* * * * *